US010249277B2

(12) United States Patent
Hoshino

(10) Patent No.: US 10,249,277 B2
(45) Date of Patent: Apr. 2, 2019

(54) KEYBOARD INSTRUMENT EQUIPPED WITH SPEAKERS

(71) Applicant: CASIO COMPUTER CO., LTD., Shibuya-ku, Tokyo (JP)

(72) Inventor: Akihisa Hoshino, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/819,476

(22) Filed: Nov. 21, 2017

(65) Prior Publication Data

US 2018/0182363 A1 Jun. 28, 2018

(30) Foreign Application Priority Data

Dec. 22, 2016 (JP) ..... 2016-249659

(51) Int. Cl.

| | |
|---|---|
| ***G10H 1/34*** | (2006.01) |
| ***H04R 1/34*** | (2006.01) |
| ***G10H 1/32*** | (2006.01) |
| *H04R 1/02* | (2006.01) |

(52) U.S. Cl.

CPC ..... *G10H 1/344* (2013.01); *G10H 1/32* (2013.01); *H04R 1/345* (2013.01); *G10H 2220/221* (2013.01); *H04R 1/02* (2013.01)

(58) Field of Classification Search

CPC ..... G10H 1/344; G10H 2220/221; H04R 1/02
See application file for complete search history.

(56) References Cited

U.S. PATENT DOCUMENTS

| | | | | |
|---|---|---|---|---|
| 8,193,438 B2 | 6/2012 | Hoshino | | |
| 2010/0288110 A1 | 11/2010 | Hoshino | | |
| 2012/0222541 A1* | 9/2012 | Ishimura | G10H 1/32 | 84/744 |
| 2013/0180387 A1* | 7/2013 | Takahashi | G10H 1/32 | 84/644 |
| 2013/0305900 A1* | 11/2013 | Nagatsuma | G10C 3/12 | 84/423 R |

FOREIGN PATENT DOCUMENTS

| | | | |
|---|---|---|---|
| JP | H03269595 | A | 12/1991 |
| JP | 2010266790 | A | 11/2010 |
| JP | 2014160219 | A | 9/2014 |
| JP | 2015011144 | A | 1/2015 |

OTHER PUBLICATIONS

Japanese Office Action dated Jan. 17, 2019 (and English translation thereof) issued in counterpart Japanese Application No. 2016-249659.

* cited by examiner

*Primary Examiner* — Mohammad K Islam

(74) *Attorney, Agent, or Firm* — Holtz, Holtz & Volek PC

(57) ABSTRACT

A keyboard instrument including a musical instrument case, a speaker which emits sounds in response to instructions from a keyboard section, and a keyboard lid which is switchable between a first arrangement state where the keyboard lid covers at least a portion of the keyboard section and a second arrangement state where the keyboard lid is opened to expose at least a portion of the keyboard section and housed in the musical instrument case, in which the keyboard lid in the second arrangement state is arranged such that a first acoustic space for leading the sounds emitted from the speaker to outside of the musical instrument case is formed between the keyboard lid and a portion of the musical instrument case.

16 Claims, 10 Drawing Sheets

KEYBOARD INSTRUMENT EQUIPPED WITH SPEAKERS

CROSS-REFERENCE TO RELATED APPLICATION

This application is based upon and claims the benefit of priority from the prior Japanese Patent Application No. 2016-249659, filed Dec. 22, 2016, the entire contents of which are incorporated herein by reference.

BACKGROUND OF THE INVENTION

1. Field of the Invention

The present invention relates to a keyboard instrument equipped with speakers.

2. Description of the Related Art

For example, a keyboard instrument is known which is provided with a keyboard section upwardly exposed in a musical instrument case and keyboard lids including a front lid and a rear lid for openably covering the keyboard section, in which sounds from speakers provided to be oriented upward on the undersurface of the musical instrument case are emitted in the anterosuperior direction of the musical instrument case, as described in Japanese Patent Application Laid-Open (Kokai) Publication No. 2014-160219.

In this structure, the front lid and the rear lid of the keyboard lid have been connected by a connection section such that the keyboard lid is foldable. When the keyboard section is exposed and the keyboard lid is housed in the musical instrument case with it being bent by the connection section, the front lid is arranged on the lower side of an upper area in the musical instrument case, and the rear lid hangs down along the rear surface of the musical instrument case. Here, an end portion of the rear lid connected to the front lid by the connection section comes in contact with the rear surface of the musical instrument case, and occupies a space between the rear lid and the rear surface of the musical instrument case.

Therefore, the keyboard lid has a sound emission notch section provided in a rear end portion of the front lid at which the front lid and the rear lid have been connected by the connection section. When the keyboard lid is housed in the musical instrument case with it being bent by the connection section, and the rear lid occupies the space between the rear lid and the rear surface of the musical instrument case, the sound emission notch section provided in the rear end portion of the front lid is opened, and sounds from the speakers are emitted upward from the musical instrument case via the opened sound emission notch section.

SUMMARY OF THE INVENTION

In accordance with one aspect of the present invention, there is provided a keyboard instrument comprising: a musical instrument case; a speaker which emits sounds in response to instructions from a keyboard section; and a keyboard lid which is switchable between a first arrangement state where the keyboard lid covers at least a portion of the keyboard section and a second arrangement state where the keyboard lid is opened to expose at least a portion of the keyboard section and housed in the musical instrument case, wherein the keyboard lid in the second arrangement state is arranged such that a first acoustic space for leading the sounds emitted from the speaker to outside of the musical instrument case is formed between the keyboard lid and a portion of the musical instrument case.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 8A and FIG. 8B are diagrams showing a diffuser for a first sound emission hole provided in the top plate of the musical instrument case shown in FIG. 3, of which FIG. 8A is an enlarged sectional view showing the main section of a first modification of the diffuser, and FIG. 8B is an enlarged sectional view showing the main section of a second modification of the diffuser;

FIG. 9A and FIG. 9B are diagrams showing a third modification example where a diffuser has been provided on the upper side of the second speaker of the electronic keyboard instrument shown in FIG. 5, of which FIG. 9A is an enlarged sectional view of the electronic keyboard instrument, and FIG. 9B is an enlarged perspective view where the second speaker and the diffuser mounted in the electronic keyboard instrument have been disassembled.

DETAILED DESCRIPTION OF THE PREFERRED EMBODIMENTS

Hereafter, an embodiment in which the present invention has been applied in an electronic keyboard instrument is described with reference to FIG. 1 to FIG. 7.

Figure 1:
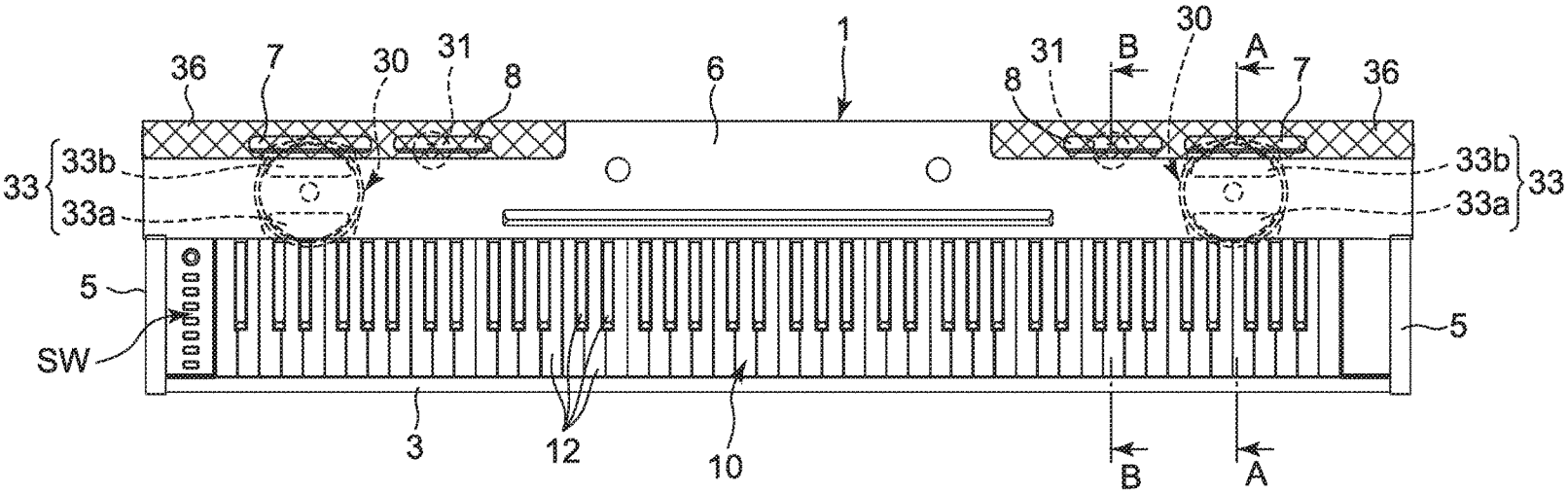
FIG. 1 is a planar view of an embodiment where the present invention has been applied in an electronic keyboard instrument.
Figure 2:
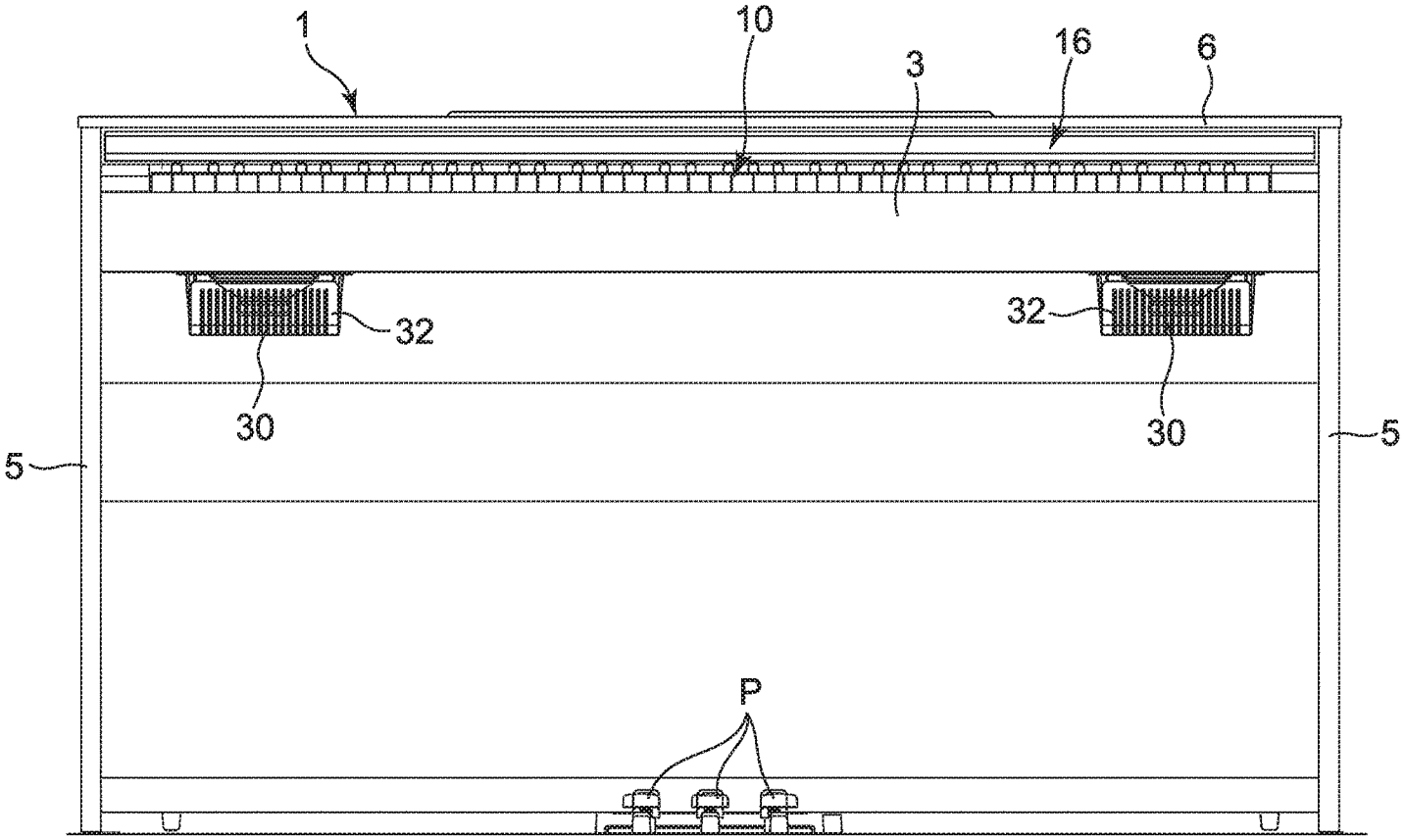
FIG. 2 is a front view of the electronic keyboard instrument shown in FIG. 1.
Figure 3:
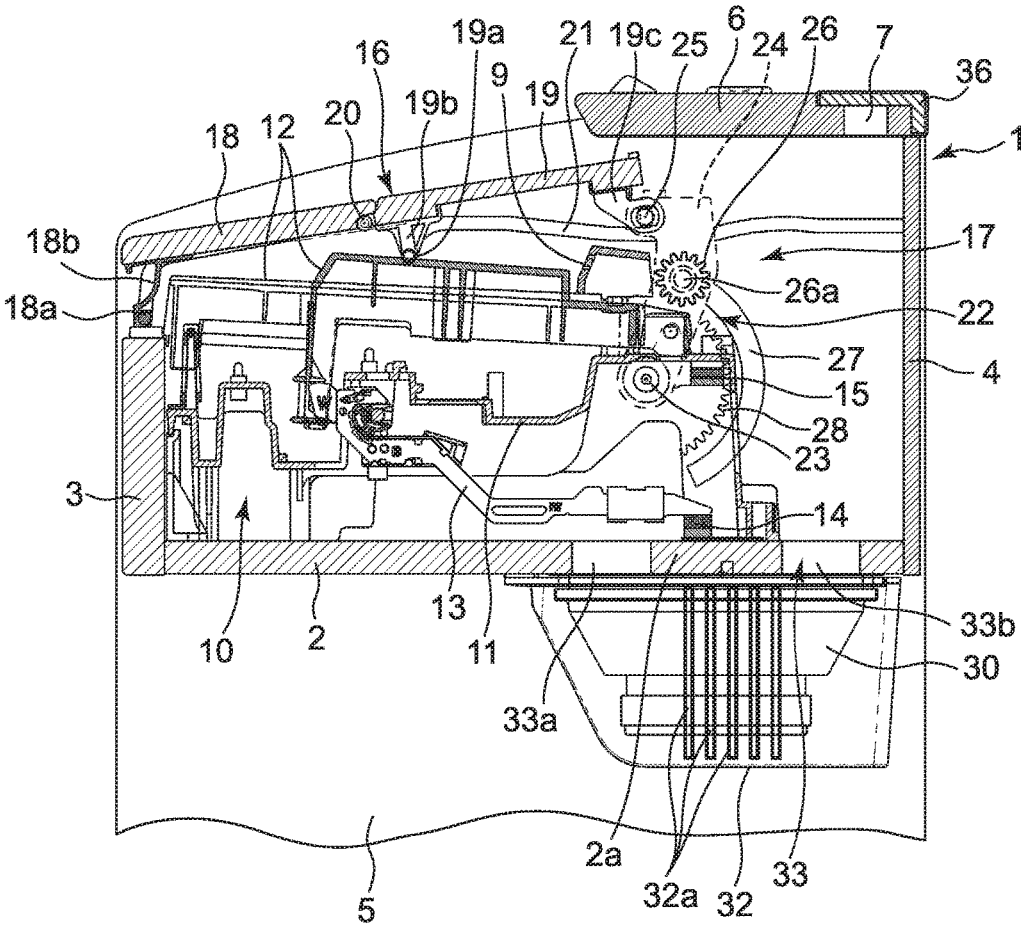
FIG. 3 is an enlarged sectional view of the electronic keyboard instrument taken along line A-A in FIG. 1.

This electronic keyboard instrument includes a musical instrument case 1, as shown in FIG. 1 to FIG. 3. The musical instrument case 1 is formed substantially in a horizontally elongated box shape whose upper front portion (upper left portion in FIG. 3) is opened.

More specifically, this musical instrument case 1 includes a bottom plate 2, a front plate 3 provided upright on the front end (left end in FIG. 3) of the bottom plate 2, a rear plate 4 provided upright on the rear end (right end in FIG. 3) of the bottom plate 2, a pair of side plates 5 provided upright on the left and right sides of the bottom plate 2 (both side portions on the front and back surfaces of the paper showing FIG. 3), and a top plate 6 provided on upper portions of the side plates 5 and the rear plate 4, as shown in FIG. 1 to FIG. 3.

In this embodiment, the front plate 3 is provided such that its height is substantially half of the height of the rear plate 4, as shown in FIG. 1 to FIG. 3. The pair of side plates 5, which serves as leg portions that support the entire musical instrument, is provided elongating below the rear plate 4. In a lower area between the pair of side plates 5 serving as leg portions, a plurality of foot pedals P are provided, as shown in FIG. 2.

Also, these side plates 5 are each formed such that the front end (the left end in FIG. 3) is slightly higher than the front plate 3, the height from its substantially middle portion in the front-to-rear direction (the left-to-right direction in FIG. 1) to the rear end (the right end in FIG. 3) is equal to the height of the rear plate 4, and its portion from the front end to the middle portion is inclined upward and rearward (upward and rightward in FIG. 3), as shown in FIG. 1 to FIG. 3.

The top plate 6 is arranged on upper rear portions of the pair of side plates 5 and the upper portion of the rear plate, as shown in FIG. 1 to FIG. 3. In the top plate 6, first sound emission holes 7 and second sound emission holes 8 described later are provided penetrating in a vertical direction. As a result, the musical instrument case 1 is formed substantially in a horizontally elongated box shape whose front side corresponding to the inclined portions of the pair of side plates 5 is open upward.

In the musical instrument case 1, a keyboard section 10 is provided, as shown in FIG. 1 to FIG. 3. On a side portion (a left side portion in FIG. 1) of this keyboard section 10, a switch section SW is provided, as shown in FIG. 1. This switch section includes various types of switches required for the electronic keyboard instrument, such as a power supply switch, a sound volume switch, and a timbre selection switch.

The keyboard section 10 includes a keyboard chassis 11 arranged on the bottom plate 2 of the musical instrument case 1, a plurality of keys 12 arranged in parallel to each other on the keyboard chassis 11 so as to be rotatable in the vertical direction, and a plurality of hammer members 13 that are rotated in response to key depression operations on the plurality of keys 12 and apply action loads to the plurality of keys 12, respectively, as shown in FIG. 1 to FIG. 3.

In this embodiment, the hammer members 13 come in contact with a lower-limit stopper 14 provided on the bottom plate 2 of the musical instrument case 1 and located in a lower rear area in the keyboard chassis 11, when the keys 12 are in their initial states where key depression operations have not been performed, as shown in FIG. 3. When rotated in response to key depression operations on the keys 12, the hammer members 13 come in contact with an upper-limit stopper 15 provided on the upper rear surface of the keyboard chassis 11 and located above the bottom plate 2 of the musical instrument case 1.

The keyboard section 10 is structured such that it is subjected to key depression operations with the plurality of keys 12 being upwardly exposed from the front side of the musical instrument case 1, as shown in FIG. 3. Also, the keyboard section 10 is structured such that, when the plurality of keys 12 are subjected to key depression operations, switching sections (not shown) provided on the keyboard chassis 11 perform switching actions and output switch signals, respectively. In this embodiment, in the musical instrument case, a console panel 9 is provided extending rearward from an area above a rear portion of the keyboard section 10.

Figure 4:
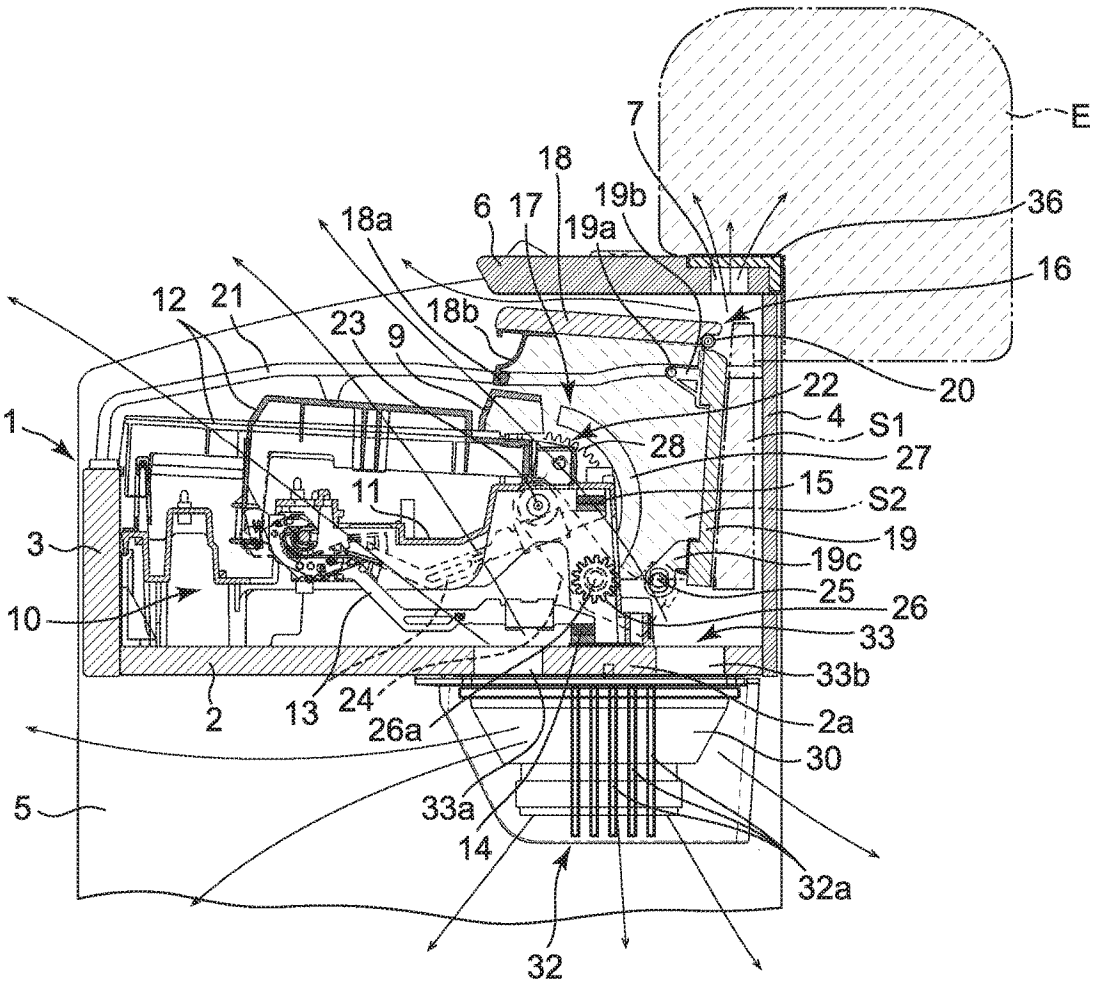
FIG. 4 is an enlarged sectional view of the electronic keyboard instrument shown in FIG. 3, in which a keyboard lid has been opened and housed in a musical instrument case.
Figure 5:
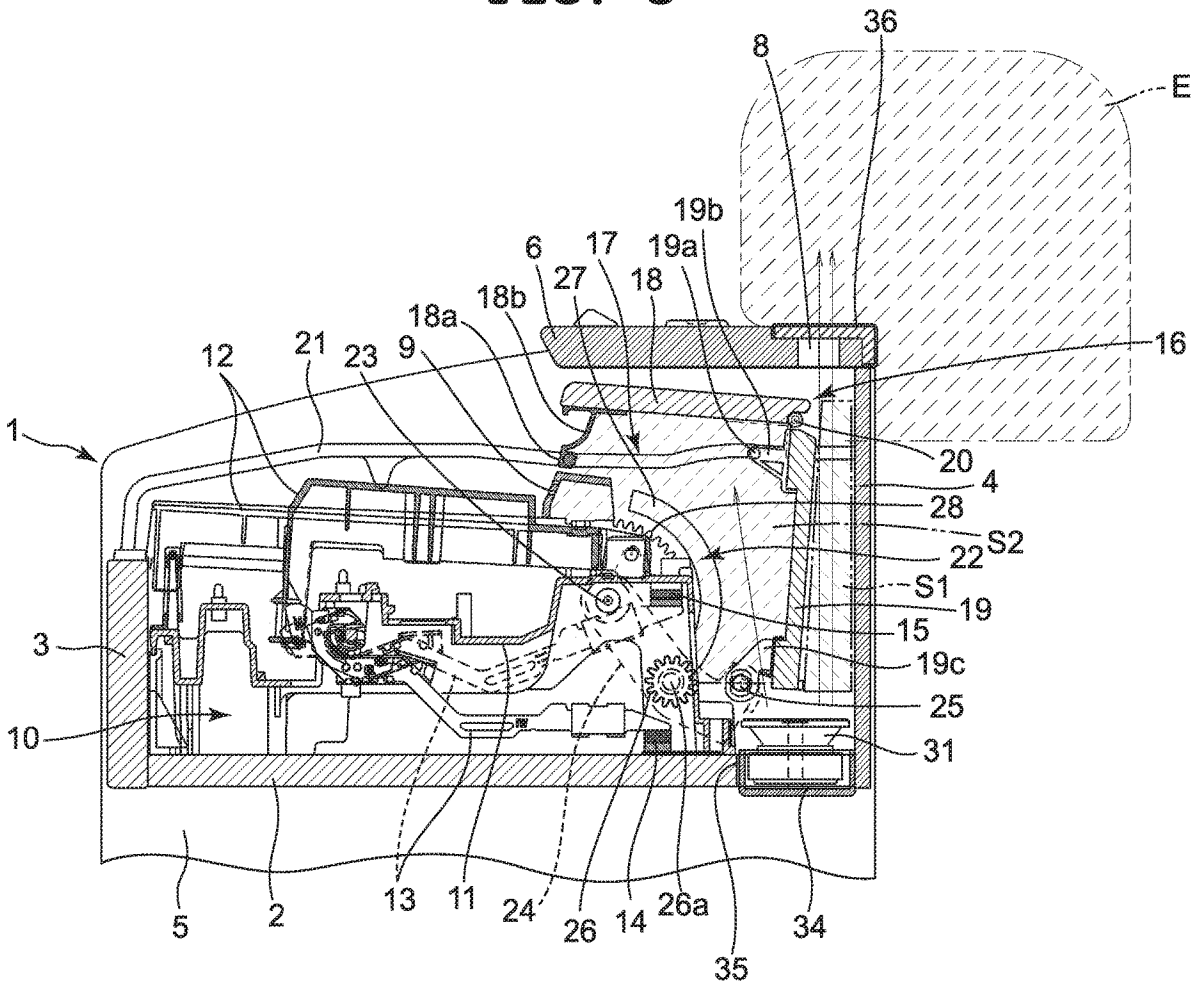
FIG. 5 is an enlarged sectional view of the electronic keyboard instrument taken along line B-B in FIG. 1, in which the keyboard lid has been opened and housed in the musical instrument case.

Also, in the musical instrument case 1, a keyboard lid 16 for covering the upper side of the keyboard section 10 is provided in a manner to be openable and closable by a lid guide section 17, as shown in FIG. 3 to FIG. 5. This keyboard lid 16 includes a front lid 18 and a rear lid 19, and is foldable at hinges 20 coupling the front lid 18 and the rear lid 19 together.

In this embodiment, on the front end of the front lid 18, guide shafts 18*a* projecting toward the inner sides of the pair of side plates 5 are provided via supporting legs 18*b*, as shown in FIG. 3 to FIG. 5. In addition, on the front end of the rear lid 19, guide shafts 19*a* projecting toward the inner sides of the pair of side plates 5 are provided via supporting legs 19*b*. On the rear end of the rear lid 19, shaft attaching sections 19*c* are provided.

The lid guide section 17 shown in FIG. 3 to FIG. 5 is structured such that the front lid 18 and the rear lid 19 are arranged to be substantially flush with each other when the keyboard lid 16 covers the upper side of the keyboard section 10. In addition, the lid guide section 17 is structured such that the keyboard lid 16 is folded at the hinges 20, the front lid 18 is positioned near the undersurface of the top plate 6, and the rear lid 19 hangs down while being positioned at a distance from the rear plate 4 when the keyboard lid 16 is housed in the rear side of the musical instrument case so as to expose the keyboard section 10 upward.

More specifically, the lid guide section 17 includes guide rail sections 21 and guide members 22, as shown in FIG. 3 to FIG. 5. The guide rail sections 21 are provided on the inner surfaces of the pair of side plates 5 and located from an area above the front plate 3 toward the rear plate 4 via an area above the console panel 9. These guide rail sections 21 guide the guide shafts 18*a* of the front lid 18 of the keyboard lid 16 and the guide shafts 19*a* of the rear lid 19, respectively.

As a result, the guide rail sections 21 are structured such that, when the front lid 18 and the rear lid 19 cover the upper side of the keyboard section 10, the guide shafts 18*a* of the front lid 18 are supported by the front ends of the guide rail sections 21, the guide shafts 19*a* of the rear lid 19 are supported by portions of the guide rail sections 21 corresponding to a substantially middle portion of the keyboard section 10, and the front lid 18 and the rear lid 19 are arranged to be flush with each other with them being tilted in an anteroinferior direction, as shown in FIG. 3.

Also, the guide rail sections 21 are structured such that, when the keyboard lid 16 is housed in the rear side of the musical instrument case 1 so as to expose the keyboard section 10 upward, the guide shafts 18*a* of the front lid 18 are supported by portions of the guide rail sections 21 corresponding to a lower portion of the front end of the top plate 6, the guide shafts 19*a* of the rear lid 19 are supported by rear end portions of the guide rail sections 21, the front lid 18 is arranged near the underside of the top plate 6, and the rear lid 19 is rotated around the hinges 20 toward the front lid 18 and hangs down between the rear plate 4 and the rear portion of the keyboard section 10 while being positioned at a distance from the rear plate 4, as shown in FIG. 4 and FIG. 5.

On the other hand, the guide members 22 include support shafts 23 provided on portions of the side plates 5 corresponding to an area under the rear portion of the keyboard section 10, arm sections 24 rotatably attached to the support shafts 23, and connection shafts 25 rotatably connecting tip end portions of the arm sections 24 with the shaft attaching sections 19*c* of the rear lid 19, as shown in FIG. 3 to FIG. 5. These guide members 22 are structured such that, by the arm sections 24 being rotated around the support shafts 23 in the vertical direction and the connecting shafts 25 being rotated in the vertical direction, the rear end of the rear cover is rotated in the vertical direction so as to be moved between an upper area corresponding to the guide rail sections 21 and a lower area behind the keyboard section 10.

As a result, the lid guide section 17 is structured such that, when the front lid 18 and the rear lid 19 of the keyboard lid 16 are closed to cover the upper side of the keyboard section 10, the arm sections 24 of the guide members 22 are rotated counterclockwise around the support shafts 23 so as to stand upright, whereby the connecting shafts 25 at the rear end of the rear lid 19 are held in areas corresponding to the guide rail sections 21, and the front lid 18 and the rear lid 19 are arranged to be flush with each other with them being tilted in the anteroinferior direction, as shown in FIG. 3.

Also, the lid guide section 17 is structured such that, when the keyboard lid 16 is opened to upwardly expose the keyboard section 10 and housed in the rear side of the musical instrument case 1, the arm sections 24 of the guide members 22 are rotated clockwise around the support shafts 23 so as to be tilted in the posteroinferior direction, whereby the connecting shafts 25 at the rear end of the rear lid 19 are held in a lower rear area, as shown in FIG. 4 and FIG. 5.

In this embodiment, the guide members 22 include pinions 26 provided on middle portions of the arm sections 24, guide grooves 27 having an arc-like shape which are provided in the inner surfaces of the side plates 5 and guide pinion shafts 26*a* of the pinions 26, and racks 28 having an arc-like shape which are provided on the inner surfaces of the side plates 5 and rotated while being meshed with the pinions 26, as shown in FIG. 3 to FIG. 5.

As a result, the guide members 22 are structured such that, when the keyboard lid 16 is to be housed in the musical instrument case 1, the pinions 26 are rotated and moved from an upper area to a lower area while being meshed with the racks 28, and the pinion shafts 26*a* of the pinions 26 are moved from the upper area to the lower area while being guided by the guide grooves 27, as shown in FIG. 3 to FIG. 5.

In the musical instrument case 1, first speakers 30 that are full-range speakers and second speakers 31 for high-pitched sounds are provided in areas behind the keyboard section 10, as shown in FIG. 1 to FIG. 5. More specifically, the first speakers 30 are provided upward on both side areas on the undersurface of the bottom plate 2 of the musical instrument case 1, respectively. In this embodiment, the first speakers 30 are arranged over areas from middle portions to rear end portions of the undersurface of the bottom plate 2 via dustproof nets (not shown) provided on the undersurface of the bottom plate 2 of the musical instrument case 1.

Figure 6:
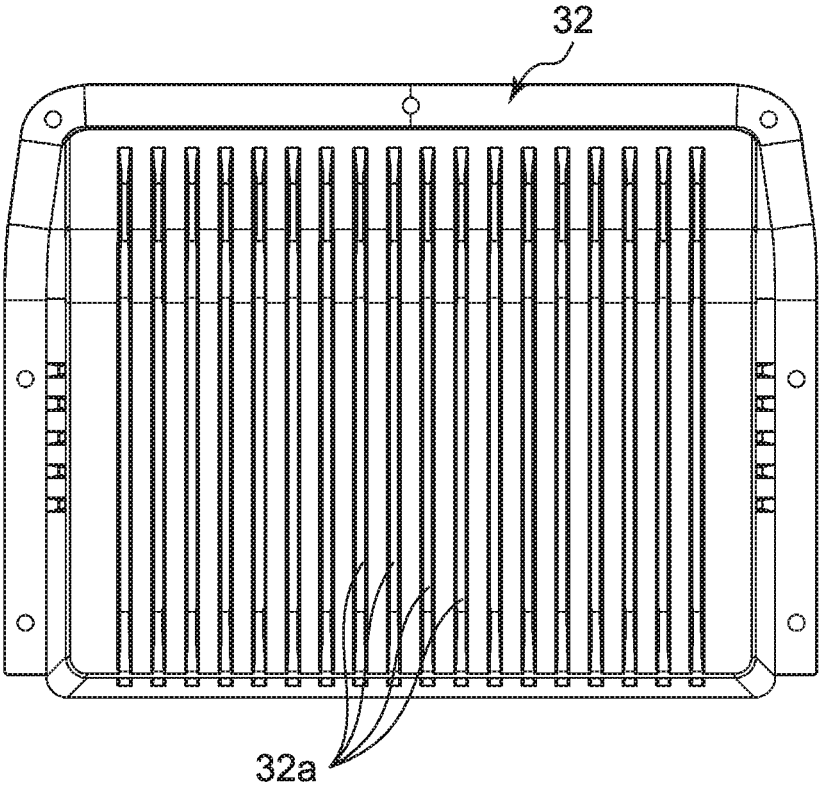
FIG. 6 is an enlarged bottom view of a first speaker box for a first speaker shown in FIG. 3.

Each of the first speakers 30 has a first speaker box 32 surrounding its peripheral portion, as shown in FIG. 2 to FIG. 4. In the bottom and peripheral surface of each first speaker box 32, a plurality of slit holes 32*a* for sound emission are provided, as shown in FIG. 6. As a result, each first speaker box 32 is structured such that musical sounds from the corresponding first speakers 30 are emitted in downward, front, rear, right, and left directions from the plurality of slit holes 32*a* for sound emission and thereby widely transmitted.

In this embodiment, in portions of the bottom plate 2 of the musical instrument case 1 corresponding to the first speakers 30, sound reception holes 33 for taking musical sounds emitted from the first speakers 30 into the musical instrument case 1 are provided penetrating in the vertical direction, as shown in FIG. 3 and FIG. 4. Here, each sound reception hole 33 includes a front side hole 33*a* located corresponding to the front side of the first speakers 30 and a rear side hole 33*b* located corresponding to the rear side of the first speakers 30.

In this embodiment, a portion of the bottom plate 2 located between the front side hole 33*a* and the rear side hole 33*b* serves as a mounting section 2*a* for reinforcement on which a rear end portion of the keyboard chassis 11 and the lower-limit stopper 14 for the hammer members 13 are arranged, as shown in FIG. 3 and FIG. 4. This mounting section 2*a* is to firmly support the lower-limit stoppers 14 with which the hammer members 13 come in contact and the rear end portion of the keyboard chassis 11.

The front side holes 33*a* of the sound reception holes 33 are provided in positions closer to the front of the electronic keyboard instrument than that of the rear end of the keyboard section 10, and emit sounds transmitted from the first speakers 30 to the inner side of the keyboard section 10 in the musical instrument case 1, as shown in FIG. 4. As a result, the first speakers 30 are structured such that musical sounds emitted therefrom are taken into the keyboard section 10 from the front side holes 33*a* of the sound reception holes 33, and emitted in an anterosuperior direction through spaces between the plurality of keys 12 of the keyboard section 10 and spaces between the plurality of hammer members 13.

The rear side holes 33*b* are provided and positioned in substantially middle areas between the rear end of the keyboard section 10 and the rear plate 4 of the musical instrument case 1, and correspond to the lower side of the rear lid when the keyboard lid 16 is opened to expose the keyboard section 10, as shown in FIG. 4. As a result, the rear side holes 33*b* are structured such that musical sounds emitted from the first speakers 30 are taken into an area between the rear plate 4 of the musical instrument case 1 and the rear end of the keyboard section 10, and separated toward the front side and the rear side by the rear lid 19 hanging down in the rear part of the musical instrument case 1.

In this embodiment, when hanging down in the rear part of the musical instrument case 1, the rear lid 19 is located at a distance from the rear plate 4 of the musical instrument case 1, whereby a first acoustic space S1 is created between the rear lid 19 and the rear plate 4, as shown in FIG. 4 and FIG. 5. In addition, when hanging down in the rear part of the musical instrument case 1, the rear lid 19 is located at a distance from the rear end of the keyboard section 10, whereby a second acoustic space S2 is created between the rear end of the keyboard section 10 and the rear lid 19.

That is, the second acoustic space S2 includes a space surrounded by the rear end of the keyboard section 10, the rear lid 19, and the side plates 5, and a space surrounded by an upper rear portion of the keyboard section 10, the front lid 18, and the side plates 5, as shown in FIG. 4 and FIG. 5. On the other hand, the first acoustic space S1 is a space surrounded by the rear lid 19, the rear plate 4, and the left and right side plates 5. This first acoustic space S1 is formed such that its length in the front-to-rear direction is gradually shorten from its lower side toward its upper side.

As a result, this first sound space S1 leads musical sounds emitted from the first speakers 30 that are full-range speakers and the second speakers 31 for high-pitched sounds toward the upper side from the lower side while increasing the sound pressures of the musical sounds thereby, and emit the musical sounds whose sound pressures have been increased toward an acoustic area E above the musical instrument case 1 from the first sound emission holes 7 and the second sound emission holes 8 of the top plate 6.

In this embodiment, the first sound emission holes 7 are provided above portions of the first acoustic space S1 corresponding to the first speakers 30, as shown in FIG. 1 and FIG. 4. The second sound emission holes 8 are provided above portions of the first acoustic space S1 corresponding to the second speakers 31, as shown in FIG. 1 and FIG. 5. The lengths of the first sound emission holes 7 and the second sound emission holes 8 in the front-to-rear direction are shorter than the length of the upper end of the first acoustic space S1 in the front-to-rear direction, that is, the length of the narrowest portion of the first acoustic space S1, and their lengths in the left-to-right direction are substantially the same as the outer diameters of the first speakers 30.

As a result, the first speakers 30 are structured such that, when musical sounds emitted therefrom are taken into the rear part of the musical instrument case 1 from the rear side holes 33*b* of the sound reception holes 33, part of the taken musical sounds transmitted to the front side by partition by the rear lid 19 is emitted in the anterosuperior direction of the musical instrument case 1 from the second acoustic space S2 formed between the rear and of the keyboard section 10 and the rear lid 19 and between the front lid 18 positioned under the top plate 6 of the musical instrument case 1 and the upper rear portion of the keyboard section 10, as shown in FIG. 4.

In this embodiment, in the console 9 arranged posterosuperior to the keyboard section 10, a number of sound emission holes (not shown) are provided. As a result, the console 9 is structured such that musical sounds transmitted to the area between the front lid 18 positioned under the top plate 6 and the rear upper portion of the keyboard section 10 are emitted toward the anterosuperior direction of the musical instrument case 1 through a number of sound emission holes provided in the console 9 without being interrupted by the console 9, as shown in FIG. 4.

Also, the first speakers 30 are structured such that, when musical sounds emitted therefrom are taken into the rear part of the musical instrument case 1 from the rear side holes 33*b* of the sound reception holes 33, part of the taken musical sounds transmitted to the rear side by partition by the rear lid 19 passes through the first acoustic space S1 between the rear lid 19 and the rear plate 4 and is emitted toward an acoustic space B above the musical instrument case 1 from the first sound emission holes 7 provided in the top plate 6 of the musical instrument case 1, as shown in FIG. 4.

On the other hand, the second speakers 31 are provided upward in side portions of the bottom plates 2 of the musical instrument case 1 near the first speakers 30, respectively, as shown in FIG. 1 and FIG. 5. These second speakers 31 are provided and positioned between the rear end of the keyboard section 10 and the rear plate 4 of the musical instrument case 1, and correspond to the lower side of the rear lid 19 when the keyboard lid 16 is opened to expose the keyboard section 10.

Figure 7:
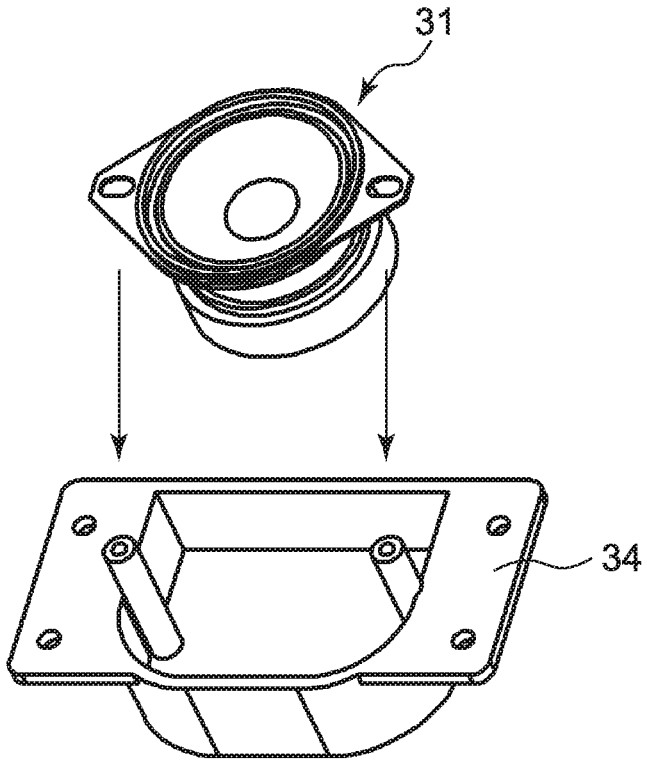
FIG. 7 is an enlarged perspective view where a second speaker and a second speaker box shown in FIG. 5 have been disassembled.

More specifically, the second speakers 31 are arranged in second speaker boxes 34, as shown in FIG. 7. These second speaker boxes 34 are fitted into fitting holes 35 provided in the bottom plate 2 and located between the rear end of the keyboard section 10 and the rear plate 4 of the musical instrument case 1, and thereby arranged upward in the musical instrument case 1. Accordingly, musical sounds emitted from the second speakers 31 are separated toward the front side and the rear side by the rear lid 19 hanging down in the rear part of the musical instrument case 1.

As a result, the second speakers 30 are structured such that, among musical sounds emitted therefrom, musical sounds transmitted to the front side by partition by the rear lid 19 are emitted in the anterosuperior direction of the musical instrument case 1 from the second acoustic space S2 formed between the rear end of the keyboard section 10 and the rear lid 19 and between the front lid 18 positioned under the top plate 6 of the musical instrument case 1 and the upper rear portion of the keyboard section 10 and from a number of sound emission holes (not shown) in the console 9 arranged therebetween, as shown in FIG. 5.

Also, the second speakers 30 are structured such that, among musical sounds emitted therefrom, musical sounds transmitted to the rear side by partition by the rear lid 19 pass through the first acoustic space S1 between the rear lid 19 and the rear plate 4 and are emitted toward the acoustic space E above the musical instrument case 1 from the second sound emission holes 8 provided in the top plate 6 of the musical instrument case 1, as shown in FIG. 5.

Next, the mechanism of the electronic keyboard instrument is described.

When a musical performance using the electronic keyboard instrument is to be started, first, the keyboard lid 16 is opened to expose the keyboard section 10 upward. Here, when the front end of the front lid 18 is lifted and moved rearward, the guide shafts 18*a* of the front lid 18 and the guide shafts 19*a* of the rear lid 16 are moved rearward along the guide rail sections 21, the arm sections 24 of the guide members 22 are rotated clockwise around the support shafts 23, the keyboard lid 16 is gradually folded by the hinges 20, and the rear lid 19 is moved toward an area behind the lower part of the keyboard section 10.

Then, the guide shafts 18*a* of the front lid 18 are positioned in the above-described portions of the guide rail sections 21 located under the front end of the top plate 6, the guide shafts 19*a* of the rear lid 19 are positioned in the rear ends of the guide rail sections 21, and the connection shafts 25 at the shaft attaching sections 19*o* on the rear end of the rear lid 16 are positioned in the area behind the lower part of the keyboard section 10, whereby the front lid 18 is substantially flatly arranged under the top plate 6 and the rear lid 19 rotated with respect to the front lid 18 by the hinge 20 is arranged hanging down in a substantially middle area between the rear plate 4 and the rear end of the keyboard section 10.

In this state, since the keyboard section 10 has been exposed upward and therefore the plurality of keys 12 have been exposed upward, a musical performance can be started. When a musical performance is started by key depression operations being performed on keys 12 of the keyboard section 10, musical sounds in accordance with the key depression operations are emitted from the first speakers 30 that are full-range speakers and the second speakers 31 for high-pitched sounds.

Here, musical sounds from the first speakers 30 that are full-range speakers are widely emitted in the downward, front, rear, right, and left directions from the plurality of slit holes 32*a* for sound emission. In addition, part of the musical sounds are taken into the musical instrument case 1 from the sound reception holes 33 provided in the bottom plate 2 of the musical instrument case 1, and emitted in the anterosuperior direction and the upper direction of the musical instrument case 1.

That is, when taken into the keyboard section 10 from the front side holes 33*a* of the sound reception holes 33, musical sounds from the first speakers 30 are emitted in the antero-superior direction of the musical instrument case 1 through spaces between the plurality of keys 12 of the keyboard section 10 and spaces between the plurality of hammer members 13, as shown in FIG. 4.

Also, among musical sounds emitted by the first speakers 30 and taken into the rear part of the musical instrument case 1 from the rear side holes 33*b* of the sound reception holes 33, musical sounds transmitted to the front side by partition by the rear lid 19 are emitted in the anterosuperior direction of the musical instrument case 1 from the second acoustic space S2 formed between the rear end of the keyboard section 10 and the rear lid 19 and between the front lid 18 positioned under the top plate 6 of the musical instrument case 1 and the upper rear portion of the keyboard section 10, and from a number of sound emission holes (not shown) in the console 9 arranged therebetween, as shown in FIG. 4.

Moreover, musical sounds emitted from the first speakers 30 and transmitted to the rear side by partition by the rear lid 19 pass through the first acoustic space S1 between the rear lid 19 and the rear plate 4 and are emitted toward the acoustic space E above the musical instrument case 1 from the first sound emission holes 7 provided in the top plate 6 of the musical instrument case 1, as shown in FIG. 4.

Here, since the first acoustic space S1 has been formed such that its length in the front-to-rear direction is gradually shorten from its lower side toward its upper side, the sound pressures of the musical sounds are increased by this first acoustic space S1. In addition, by the lengths of the first sound emission holes 7 in the front-to-rear direction being shorter than the length of the upper end of the first acoustic space S1 in the front-to-rear direction, the sound pressures of the musical sounds are further increased, and the musical sounds whose sound pressures have been increased are emitted toward the acoustic area E located posterosuperior to the musical instrument case 1.

When the musical sounds from the first speakers 30 are emitted toward the acoustic area E located posterosuperior to the musical instrument case 1, by this acoustic area E, the emitted musical sounds are heard as if they are coming from a point distant in the rear direction by a length longer than the length of the musical instrument case 1 in the front-to-rear direction, whereby a sound effect that adds depth is achieved.

On the other hand, among musical sounds emitted from the second speakers 30 for high-pitched sounds, musical sounds transmitted to the front side by partition by the rear lid 19 are emitted in the anterosuperior direction of the musical instrument case 1 from the second acoustic space S2 formed between the rear end of the keyboard section 10 and the rear lid 19 and between the front lid 18 positioned under the top plate 6 of the musical instrument case 1 and the upper rear portion of the keyboard section 10, and from a number of sound emission holes (not shown) in the console 9 arranged therebetween, as shown in FIG. 5.

Also, musical sounds emitted from the second speakers 30 and transmitted to the rear side by partition by the rear lid 19 pass through the first acoustic space S1 between the rear lid 19 and the rear plate 4 and are emitted toward the acoustic space E located posterosuperior to the musical instrument case 1 from the second sound emission holes 8 provided in the top plate 6 of the musical instrument case 1.

In this case as well, since the first acoustic space S1 has been formed such that its length in the front-to-rear direction is gradually shorten from its lower side toward its upper side, the sound pressures of the musical sounds are increased by this first acoustic space S1. In addition, by the lengths of the second sound emission holes 8 in the front-to-rear direction being shorter than the length of the upper end of the first acoustic space S1 in the front-to-rear direction, the sound pressures of the musical sounds are further increased, and the musical sounds whose sound pressures have been increased are emitted toward the acoustic area E located posterosuperior to the musical instrument case 1.

When the musical sounds from the second speakers 31 are emitted toward the acoustic area E located posterosuperior to the musical instrument case 1, by this acoustic area E, the emitted musical sounds are heard as if they are coming from a point distant in the rear direction by a length longer than the length of the musical instrument case 1 in the front-to-rear direction, whereby a sound effect that adds depth is achieved, as in the case of the musical sounds emitted from the first speakers 30.

On the other hand, when no musical performance is performed, the keyboard lid 16 is closed to cover the keyboard section 10. Here, when the front end of the front lid 18 of the keyboard lid 16 is drawn toward the front side of the musical instrument case 1, the guide shafts 18*a* of the front lid 18 and the guide shafts 18*a* of the rear lid 19 are moved along the guide rail sections 21, and the arm sections 24 of the guide members 22 are rotated counterclockwise around the support shafts 23. As a result, the keyboard lid 16 is gradually unfolded by the hinges 20 and the rear end of the rear lid 19 is moved to an area corresponding to the guide rail sections 21.

Accordingly, the guide shafts 18*a* of the front lid 18 are positioned in the front end portions of the guide rail sections 21 located above the front plate 3 of the musical instrument case 1, the guide shafts 18*a* of the rear lid 19 are positioned in middle portions of the guide rail sections 21, and the connection shafts 25 of the shaft attaching sections 19*c* on the rear end of the rear lid 19 are positioned in areas corresponding to the guide rail sections 21. As a result, the front lid 18 and the rear lid 19 are arranged to be flush with each other while being tilted in the anteroinferior direction, whereby the keyboard section 10 is covered by the front lid 18 and the rear lid 19.

As described above, the electronic keyboard instrument includes the musical instrument case 1, the first speakers 30 and the second speakers 31 which emit musical sounds in response to instructions from the keyboard section 10, and the keyboard lid 16 which can be opened and closed above the keyboard section 10. The keyboard lid 16 is arranged such that, when it is opened to expose the keyboard section 10, musical sounds from the first speakers 30 and the second speakers 31 are emitted outside the musical instrument case 1 via the first acoustic space S1 formed in the musical instrument case 1 and located behind the keyboard lid 16 and the second acoustic space S2 formed in the musical instrument case 1 and located in front of the keyboard lid 16. As a result of this structure, musical sounds from the first speakers 30 and the second speakers 31 can be favorably emitted.

That is, in this electronic keyboard instrument, by the keyboard lid 16 housed in the musical instrument case 1, musical sounds from the first speakers 30 and the second speakers 31 can be favorably separated toward the second acoustic space S2 in front of the rear lid 19 and the first acoustic space S1 behind the rear lid 19, and thereby efficiently and favorably emitted frontward and upward from the musical instrument case 1, so that the acoustic performance can be improved.

In the electronic keyboard instrument of the present embodiment, the keyboard lid 16 includes the front lid 18 and the rear lid 19. When the keyboard lid 16 is opened to expose the keyboard section 10, the rear lid 19 is substantially vertically arranged and the front lid 18 is substantially horizontally arranged. As a result, the first acoustic space S1 can be formed between the rear plate 4 of the musical instrument case 1 and the rear lid 19, and the second acoustic space S2 can be formed between the keyboard section 10 and the keyboard lid 16, whereby musical sounds from the first speakers 30 and the second speakers 31 can be favorably led to the outside of the musical instrument case 1 and the acoustic performance can be improved.

Also, in the electronic keyboard instrument, in the upper part of the musical instrument case 1, the first sound emission holes 7 and the second sound emission holes 8 are provided corresponding to the top of the first acoustic space S1. Therefore, when musical sounds from the first speakers 30 and the second speakers 31 are led by the first acoustic space S1, they can be efficiently and favorably emitted upward from the musical instrument case 1 through the first sound emission holes 7 and the second sound emission holes 8 provided in the upper part of the musical instrument case 1

In this embodiment, the first acoustic space S1 is formed such that its length in the front-to-rear direction is gradually shorten from its lower side toward its upper side. Therefore, when musical sounds from the first speakers 30 and the second speakers 31 are led by the first acoustic space S1, their sound pressures can be efficiently and favorably increased.

Also, the first sound emission holes 7 and the second sound emission holes 8 are provided such that their lengths in the front-to-rear direction are shorter than the length of the upper end of the first sound space S1 in the front-to-rear direction. As a result, the sound pressures of musical sounds whose sound pressures have already been increased by the first acoustic space 81 can be further increased and favorably emitted to the acoustic area E located posterosuperior to the musical instrument case 1 from the first sound emission holes 7 and the second sound emission holes 8.

That is, when musical sounds from the first speakers 30 and the second speakers 31 are emitted toward the acoustic area E located posterosuperior to the musical instrument case 1, by this acoustic area B, the emitted musical sounds are heard as if they are coming from a point distant in the rear direction by a length longer than the length of the musical instrument case 1 in the front-to-rear direction, whereby a sound effect that adds depth is achieved.

In this embodiment, the first speakers 30 are full-range speakers, and provided upward on the undersurface of the bottom plate 2 of the musical instrument case 1. In the bottom plate 2 of the musical instrument case 1, the sound reception holes 33 for taking musical sounds emitted from the first speakers into the musical instrument case 1 are provided corresponding to the first speakers 30. As a result, musical sounds from the first speakers 30 can be unfailingly and favorably taken into the musical instrument case 1 from the sound reception holes 33 of the bottom plate 2, and emitted in the upper direction and the anterosuperior direction of the musical instrument case 1.

That is, each sound reception hole 33 includes the front side hole 33*a* and the rear side hole 33*b*. Accordingly, when musical sounds from the first speakers 30 are taken into the musical instrument case 1 from the front side holes 33*a*, these musical sounds can be emitted in the anterosuperior direction of the musical instrument case 1 through spaces between the plurality of keys 12 of the keyboard section 10 and spaces between the plurality of hammer members 13. In addition, when musical sounds from the first speakers 30 are taken into the musical instrument case 1 from the rear side holes 33*b* of the sound reception holes 33, these musical sounds can be unfailingly and favorably separated toward the front side and the rear side by the rear lid 19 with the keyboard section being exposed.

Here, in the electronic keyboard instrument, musical sounds emitted from the first speakers 30 and transmitted to the front side by partition by the rear lid 19 can be favorably emitted in the anterosuperior direction of the musical instrument case 1 from the second acoustic space S2 formed between the rear end of the keyboard section 10 and the rear lid 19 and between the front lid 18 positioned under the top plate 6 of the musical instrument case 1 and the upper rear portion of the keyboard section 10.

Also, in the electronic keyboard instrument, the sound pressures of musical sounds emitted from the first speakers 30 and transmitted to the rear side by partition by the rear lid 19 can be increased by the first acoustic space S1 formed between the rear lid 19 and the rear plate 4, and these musical sounds whose sound pressures have been increased can be favorably emitted to the acoustic area E located posterosuperior to the musical instrument case 1 from the first sound emission holes 7 in the top plate 6 of the musical instrument case 1 with the sound pressures being further increased by the first sound emission holes 7.

On the other hand, the second speakers 31 are speakers for high-pitched sounds, and provided upward in the musical instrument case 1, so that musical sounds from the second speakers 31 can be emitted in the anterosuperior direction and the upper direction of the musical instrument case 1. That is, by the second speakers 31 being arranged to be positioned under the rear lid 19 when the keyboard section 10 is exposed, musical sounds from the second speakers 31 can be unfailingly and favorably separated toward the front side and the rear side by the rear lid 19.

Here, in the electronic keyboard instrument, musical sounds emitted from the second speakers 31 and transmitted to the front side by partition by the rear lid 19 can be favorably emitted in the anterosuperior direction of the musical instrument case 1 from the second acoustic space S2 formed between the rear end of the keyboard section 10 and the rear lid 19 and between the front lid 18 positioned under the top plate 6 of the musical instrument case 1 and the upper rear portion of the keyboard section 10.

Also, in the electronic keyboard instrument, the sound pressures of musical sounds emitted from the second speakers 31 and transmitted to the rear side by partition by the rear lid 19 can be increased by the first acoustic space S1 formed between the rear lid 19 and the rear plate 4, and these musical sounds whose sound pressures have been increased can be favorably emitted to the acoustic area E located posterosuperior to the musical instrument case 1 from the second sound emission holes 8 in the top plate 6 of the musical instrument case 1 with the sound pressures being further increased by the second sound emission holes 8.

MODIFICATION EXAMPLES

Next, modification examples of the above-described embodiment where the present invention has been applied in an electronic keyboard instrument are described with reference to FIG. 8A and FIG. 8B. Note that sections corresponding to those of the above-described embodiment shown in FIG. 1 to FIG. 7 are described using the same reference numerals.

Figure 8A:
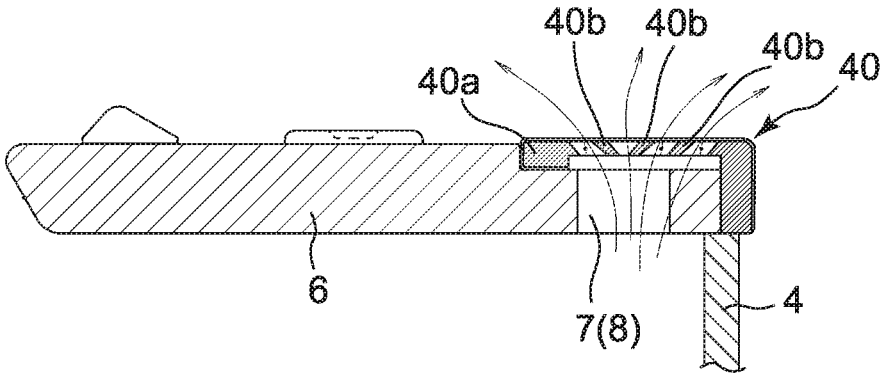

A first modification example shown in FIG. 8A has the same structure as that of the above-described embodiment except that first diffusers 40 have been provided on the first sound emission holes 7 in the top plate 6 of the musical instrument case 1.

More specifically, the first diffusers 40 are to provide directivity to musical sounds emitted toward the outside of the musical instrument case 1, and each of which includes a frame section 40*a* that is arranged on the circumferential edge of one of the first sound emission holes 7, and a plurality of fins 40*b* medially provided on the frame section 40*a* with them being tilted in the front direction or the rear direction, as shown in FIG. 8A. In this embodiment, the plurality of fins 40*b* are provided such that front side fins 40*b* are tilted frontward and rear side fins 40*b* are tilted rearward with a middle portion of the first diffuser 40 in the front-to-rear direction as a boundary between the front side and the rear side.

Accordingly, by the front side emitting musical sounds in the anterosuperior direction and the rear side emitting musical sounds in the posterosuperior direction with the middle portion in the front-to-rear direction as the boundary, each first diffuser 40 can provide directivity to musical sounds emitted toward the outside of the musical instrument case 1, as shown in FIG. 8A. As a result of this structure, depth and width can be added to musical sounds emitted from the first speakers 30.

Figure 8B:
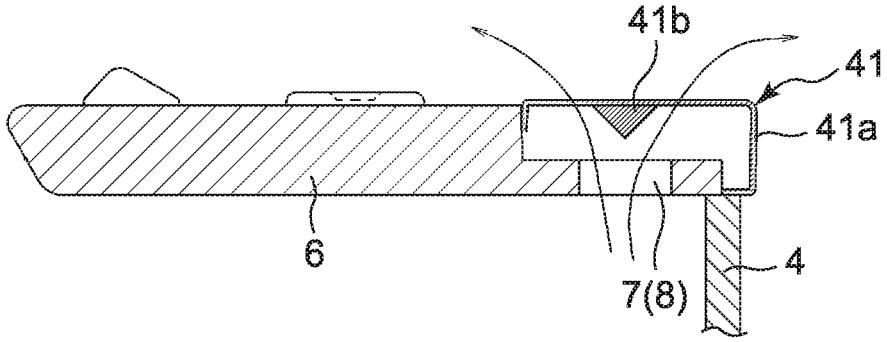

Next, in a second modification example shown in FIG. 8B, second diffusers 41 have been provided on the first sound emission holes 7 in the top plate 6 of the musical instrument case 1. These second diffusers 41 are also to provide directivity to musical sounds emitted toward the outside of the musical instrument case 1.

Each second diffuser 41 includes a frame section 41*a* that is arranged on the circumferential edge of one of the first sound emission holes 7, and a V-shaped fin 41*b* medially provided on the frame section 41*a*, as shown in FIG. 8B. In this example, the V-shaped fin 41*b* is provided on a middle portion of the frame section 41*a* in the front-to-rear direction, and transmits musical sounds in the anterosuperior direction and the posterosuperior direction.

As a result, the second diffusers 41, which transmit musical sounds in the anterosuperior direction and the posterosuperior direction separately with the middle portion in the front-to-rear direction as a boundary, can provide directivity to musical sounds emitted toward the outside of the musical instrument case 1, as shown in FIG. 8B. As a result of this structure, depth and width can be added to musical sounds emitted from the first speakers 30.

In the first modification example or the second modification example described above, the first diffusers 40 or the second diffusers 41 have been provided on the first sound emission holes 7. However, the present invention is not limited thereto and, for example, a structure may be adopted in which the first diffusers 40 or the second diffusers 41 are provided on the second sound emission holes 8. By this structure as well, directivity can be provided to musical sounds emitted toward the outside of the musical instrument case 1. Accordingly, depth can be added to musical sounds emitted from the second speakers 31, and high-pitched musical sounds can be easily transmitted to the instrument player.

Next, a third modification examples of the above-described embodiment where the present invention has been applied in an electronic keyboard instrument is described with reference to FIG. 9A and FIG. 9B. In this case as well, sections corresponding to those of the above-described embodiment shown in FIG. 1 to FIG. 7 are described using the same reference numerals.

Figure 9A:
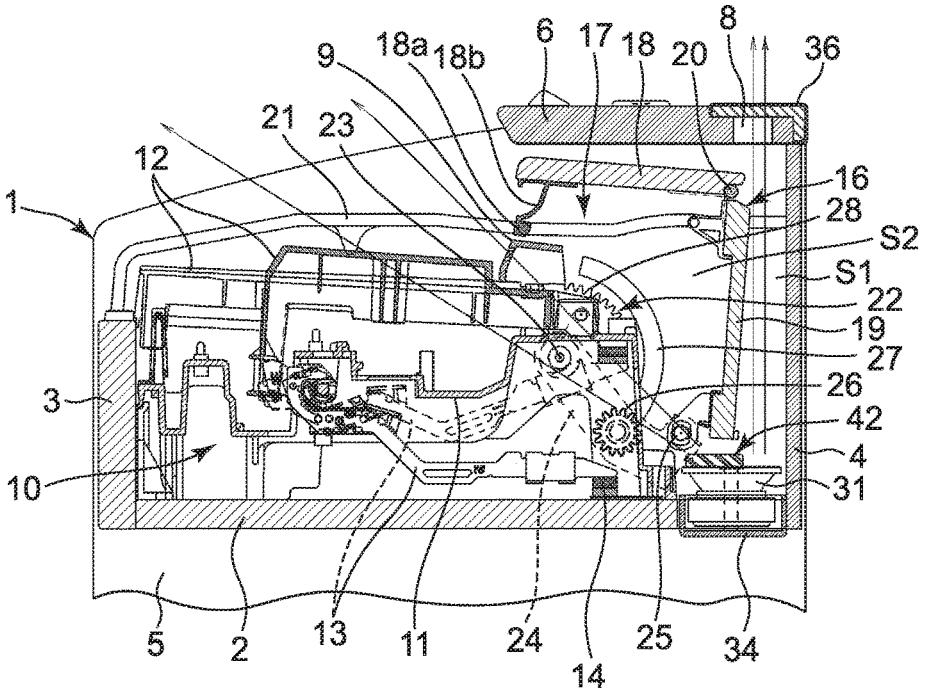
Figure 9B:
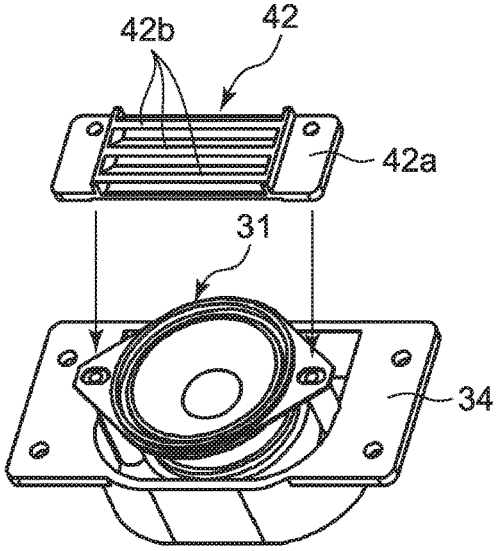

In the electronic keyboard instrument of the third modification example, third diffusers 42 have been provided on the front half of the upper surface of the second speakers 31 for high-pitched sounds, as shown in FIG. 9A and FIG. 9B.

These third diffusers 42 are to provide directivity to musical sounds emitted toward the inside of the musical instrument case 1, as shown in FIG. 9A and FIG. 9B. More specifically, each third diffuser 42 includes a frame section 42*a* that is arranged on the front half of the upper surface of one of the second speakers 31 with a point corresponding to the lower end of the rear lid 19 when the keyboard lid 16 is opened to expose the keyboard section 10 as a boundary, and a plurality of fins 42*b* medially provided on the frame section 42*a* with them being tilted frontward.

Accordingly, among musical sounds emitted from the second speakers 31, musical sounds which do not pass through the third diffusers 42 can be emitted upward from the second sound emission holes 8 provided in the top plate 6 of the musical instrument case 1 via the first acoustic space S1 provided between the rear lid 19 and the rear plate 4, as shown in FIG. 9A.

In addition, among the musical sounds emitted from the second speakers 31, musical sounds which have passed through the third diffusers 42 can be emitted in the anterosuperior direction. As a result of this structure, directivity can be provided to musical sounds, and high-pitched musical sounds can be easily transmitted to the instrument player.

Next, a fourth modification example of the above-described embodiment where the present invention has been applied in an electronic keyboard instrument is described with reference to FIG. 10. In this case as well, sections corresponding to those of the above-described embodiment shown in FIG. 1 to FIG. 7 are described using the same reference numerals.

In the electronic keyboard instrument of the fourth modification example, the second speakers 43 for high-pitched sounds have been arranged at a tilt so as to be oriented toward the anterosuperior direction.

Figure 10:
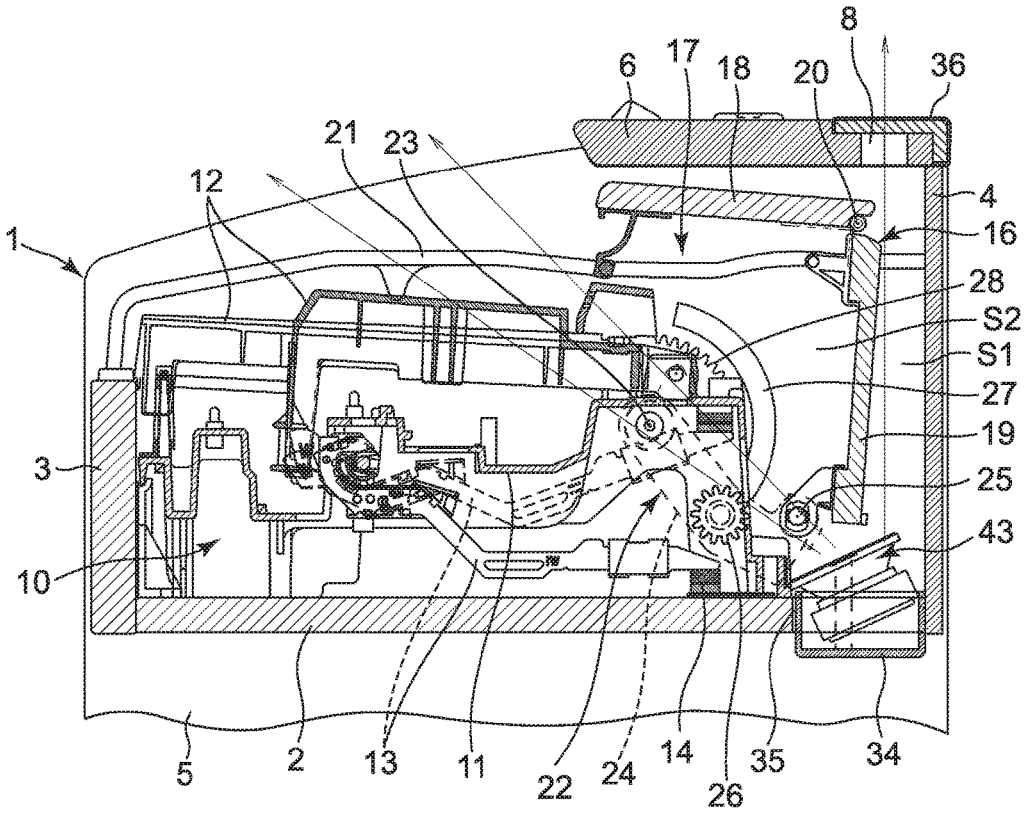
FIG. 10 is an enlarged sectional view of a fourth modification example where the attachment direction of the second speaker of the electronic keyboard instrument shown in FIG. 5 has been changed.

More specifically, the second speakers 43 have been arranged in the second speaker boxes 34 in the attachment holes 35 of the bottom plate 2 of the musical instrument case 1 with them being tilted toward the anterosuperior direction, as shown in FIG. 10. In this case as well, the second speakers 43 are arranged to be positioned under the rear lid 19 when the keyboard lid 16 is opened to expose the keyboard section 10 and the rear lid 19 is arranged hanging down in a substantially middle area between the rear end of the keyboard section 10 and the rear plate 4 of the musical instrument case 1.

By the second speakers 43 being arranged such that emitted musical sounds are separated toward the front side and the rear side by the rear lid 19, musical sounds emitted from the second speakers 43 can be unfailingly and favorably separated toward the front side and the rear side by the rear lid 19, as shown in FIG. 10.

With the second speakers 43 of this example, musical sounds transmitted to the front side by partition by the rear lid 19 can be emitted in the anterosuperior direction of the musical instrument case 1 from the second acoustic space S2 formed between the rear end of the keyboard section 10 and the rear lid 19 and between the front lid 18 positioned under the top plate 6 of the musical instrument case 1 and the upper rear portion of the keyboard section 10 and from the inside of the keyboard section 10. Accordingly, high-pitched musical sounds can be easily transmitted to the instrument player.

Also, with these second speakers 43, the sound pressures of musical sounds transmitted to the rear side by partition by the rear lid 19 can be increased by the first acoustic space S1 formed between the rear lid 19 and the rear plate 4, and these musical sounds whose sound pressures have been increased can be unfailingly and favorably emitted above the musical instrument case 1 from the second sound emission holes 8 provided in the top plate 6 of the musical instrument case 1.

Note that keyboard instruments for achieving the above-described various effects are not necessarily required to have the above-described structures and may have, for example, the structures described below.

Structural Example 1

A keyboard instrument including: a musical instrument case; a speaker which emits sounds in response to instructions from a keyboard section; and a keyboard lid which is switchable between a first arrangement state where the keyboard lid covers at least a portion of the keyboard section and a second arrangement state where the keyboard lid is opened to expose at least a portion of the keyboard section and housed in the musical instrument case, in which the keyboard lid in the second arrangement state is arranged such that a first acoustic space for leading the sounds emitted from the speaker to outside of the musical instrument case is formed between the keyboard lid and a portion of the musical instrument case.

Structural Example 2

The keyboard instrument of Structural Example 1, in which the portion of the musical instrument case is located on a rear side of the musical instrument case.

Structural Example 3

The keyboard instrument of Structural Example 2, in which the musical instrument case is provided with a first opening section and a second opening section located closer to front of the keyboard instrument than the first opening section, and in which the keyboard lid in the second arrangement state partitions a space in the musical instrument case into the first acoustic space for leading sounds emitted from the speaker to the first opening section and a second acoustic space for leading sounds emitted from the speaker to the second opening section.

Structural Example 4

The keyboard instrument of Structural Example 3, in which the speaker is provided on a rear portion of an undersurface of the musical instrument case, in which the first opening section is provided in a rear portion of an upper surface of the musical instrument case, and in which at least a part of the keyboard lid in the second arrangement state is arranged upright in a rear part of the musical instrument case, from a bottom surface direction of the musical instrument case toward an upper surface direction of the musical instrument case.

Structural Example 5

The keyboard instrument of Structural Example 4, in which the keyboard lid includes a front lid and a rear lid, and in which the rear lid of the keyboard lid in the second arrangement state is substantially vertically arranged and the front lid of the keyboard lid in the second arrangement state is substantially horizontally arranged.

Structural Example 6

The keyboard instrument of Structural Example 4, in which the part of the keyboard lid in the second arrangement state is arranged tilting rearward in the rear part of the musical instrument case, and in which the first acoustic space is formed to be gradually narrowed from a lower side thereof toward an upper side thereof.

Structural Example 7

The keyboard instrument of Structural Example 4, in which a length of the first opening section in a front-to-rear direction is formed narrower than a length of an upper side of the first acoustic space in the front-to-rear direction.

Structural Example 8

The keyboard instrument of Structural Example 3, in which the second opening section has an opening diameter corresponding to a horizontal width of the keyboard section, and in which the first opening section is a sound emission hole provided in a portion of an upper surface of the musical instrument case corresponding to the speaker.

Structural Example 9

The keyboard instrument of Structural Example 8, in which the first opening section has an opening diameter corresponding to an outer diameter of the speaker.

Structural Example 10

The keyboard instrument of Structural Example 3, in which the first opening section has provided thereon a diffuser which provides directivity to the musical sounds to be emitted to the outside of the musical instrument case.

Structural Example 11

The keyboard instrument of Structural Example 8, in which the speaker includes a first speaker that is a full-range speaker and a second speaker for high-pitched sounds, and in which the first opening section includes a first sound emission hole provided in a portion of the upper surface of the musical instrument case corresponding to the first speaker, and a second sound emission hole provided in a portion of the upper surface of the musical instrument case corresponding to the second speaker.

Structural Example 12

The keyboard instrument of Structural Example 2, in which the speaker is provided upward on an undersurface of a bottom portion of the musical instrument case, and in which the bottom portion of the of musical instrument case has a sound reception hole provided corresponding to the speaker so as to take the sounds emitted from the speaker into the musical instrument case.

Structural Example 13

The keyboard instrument of Structural Example 12, in which the sound reception hole includes a front side hole provided in an area under the keyboard section, and a rear side hole provided in area behind the keyboard section and located under the rear lid when the keyboard lid is opened to expose the keyboard section.

Structural Example 14

The keyboard instrument of Structural Example 2, in which the speaker is provided upward or provided at a tilt so as to be oriented toward an anterosuperior direction in the musical instrument case.

Structural Example 15

The keyboard instrument of Structural Example 11, in which the first speaker is provided upward on an undersurface of a bottom portion of the musical instrument case, in which the bottom portion of the of musical instrument case has a sound reception hole provided corresponding to the first speaker so as to take sounds emitted from the first speaker into the musical instrument case, and in which the second speaker is provided upward or provided at a tilt so as to be oriented toward an anterosuperior direction in the musical instrument case.

Structural Example 16

The keyboard instrument of Structural Example 3, in which the speaker has a diffuser provided on an upper front side thereof which provides directivity toward direction of the second opening section to the sounds emitted from the speaker.

Structural Example 17

A keyboard instrument including: a musical instrument case provided with a first opening section and a second opening section; a speaker which emits sounds in response to instructions from a keyboard section; and a keyboard lid whose arrangement state is switchable between a first arrangement state where the keyboard lid covers an upper side of the keyboard section and a second arrangement state where the keyboard lid is opened to expose the upper side of the keyboard section and housed in the musical instrument case, in which the keyboard lid in the second arrangement state partitions a space in the musical instrument case into a first acoustic space for leading sounds emitted from the speaker to the first opening section and a second acoustic space for leading sounds emitted from the speaker to the second opening section.

While the present invention has been described with reference to the preferred embodiments, it is intended that the invention be not limited by any of the details of the description therein but includes all the embodiments which fall within the scope of the appended claims.

What is claimed is:

1. A keyboard instrument comprising:

a musical instrument case;

a speaker which emits sounds in response to instructions from a keyboard section; and a keyboard lid which is switchable between a first arrangement state in which the keyboard lid covers at least a portion of the keyboard section and a second arrangement state in which the keyboard lid is opened to expose at least a portion of the keyboard section and housed in the musical instrument case, wherein the musical instrument case is provided with a sound emission hole penetrating a top plate of the musical instrument case in a vertical direction and an opening section located in front of the top plate, and wherein the keyboard lid, in the second arrangement state, is arranged so as to partition a space in the musical instrument case into a first acoustic space for leading the sounds emitted from the speaker to the sound emission hole and a second acoustic space for leading the sounds emitted from the speaker to the opening section.

2. The keyboard instrument according to claim 1, wherein the first acoustic space is located on a rear side of the musical instrument case.

3. The keyboard instrument according to claim 1, wherein the speaker is provided on a rear portion of an undersurface of the musical instrument case, wherein the sound emission hole is provided in a rear portion of the top plate of the musical instrument case, and wherein at least a part of the keyboard lid, in the second arrangement state, is arranged so as to be upright in a rear part of the musical instrument case, from a bottom surface direction of the musical instrument case toward an upper surface direction of the musical instrument case.

4. The keyboard instrument according to claim 3, wherein the keyboard lid includes a front lid and a rear lid, and wherein, in the second arrangement state, the rear lid of the keyboard lid is substantially vertically arranged and the front lid of the keyboard lid is substantially horizontally arranged.

5. The keyboard instrument according to claim 3, wherein the part of the keyboard lid, in the second arrangement state, is arranged so as to tilt rearward in the rear part of the musical instrument case, and wherein the first acoustic space gradually narrows from a lower side thereof toward an upper side thereof.

6. The keyboard instrument according to claim 3, wherein a length of the sound emission hole in a front-to-rear direction is narrower than a length of an upper side of the first acoustic space in the front-to-rear direction.

7. The keyboard instrument according to claim 1, wherein the opening section has an opening diameter corresponding to a horizontal width of the keyboard section, and wherein the sound emission hole is provided in a portion of the top plate corresponding to the speaker.

8. The keyboard instrument according to claim 7, wherein the sound emission hole has an opening diameter corresponding to an outer diameter of the speaker.

9. A keyboard instrument, comprising:

a musical instrument case;

a speaker which emits sounds in response to instructions from a keyboard section; and a keyboard lid which is switchable between a first arrangement state in which the keyboard lid covers at least a portion of the keyboard section and a second arrangement state in which the keyboard lid is opened to expose at least a portion of the keyboard section and housed in the musical instrument case, wherein the musical instrument case is provided with an opening section, wherein the keyboard lid, in the second arrangement state, is arranged such that a first acoustic space for leading the sounds emitted from the speaker to the opening section is formed between the keyboard lid and a rear plate of the musical instrument case, and wherein the opening section has provided thereon a diffuser which provides directivity to the sounds emitted from the speaker to outside of the musical instrument case.

10. A keyboard instrument, comprising:

a musical instrument case;

at least one speaker which emits sounds in response to instructions from a keyboard section; and a keyboard lid which is switchable between a first arrangement state in which the keyboard lid covers at least a portion of the keyboard section and a second arrangement state in which the keyboard lid is opened to expose at least a portion of the keyboard section and housed in the musical instrument case, wherein the at least one speaker includes a first speaker and a second speaker, wherein the musical instrument case is provided with a first sound emission hole provided in a portion of an upper surface of the musical instrument case corresponding to the first speaker, and a second sound emission hole provided in a portion of the upper surface of the musical instrument case corresponding to the second speaker, and wherein the keyboard lid, in the second arrangement state, is arranged such that a first acoustic space for leading the sounds emitted from the first and second speakers to the first and second sound emission holes is formed between the keyboard lid and a rear plate of the musical instrument case.

11. A keyboard instrument comprising:

a musical instrument case;

a speaker which emits sounds in response to instructions from a keyboard section; and a keyboard lid which is switchable between a first arrangement state in which the keyboard lid covers at least a portion of the keyboard section and a second arrangement state in which the keyboard lid is opened to expose at least a portion of the keyboard section and housed in the musical instrument case, wherein the musical instrument case is provided with an opening section, wherein the keyboard lid, in the second arrangement state, is arranged such that a first acoustic space for leading the sounds emitted from the speaker to the opening section is formed between the keyboard lid and a rear plate of the musical instrument case, wherein the speaker is provided facing upward on an undersurface of a bottom portion of the musical instrument case, wherein the bottom portion of the of musical instrument case has a sound reception hole provided corresponding to the speaker so as to take the sounds emitted from the speaker into the musical instrument case, wherein the sound reception hole includes a front side hole provided in an area under the keyboard section, and a rear side hole provided rearward of the front side hole in an area behind the keyboard section, and wherein the rear side hole is provided at a position and has a width such that, in a state where the keyboard lid hangs down in a rear part of the musical instrument case while being opened to expose the keyboard section, the rear side hole is opened from a position in front of a rear end of the keyboard section to a position behind the rear end of the keyboard section that corresponds to the first acoustic space, and such that the sounds emitted from the speaker and passing through the rear side hole are separated toward a front side and a rear side of the keyboard lid.

12. The keyboard instrument according to claim 2, wherein the speaker is provided facing upward or provided at a tilt so as to be oriented toward an anterosuperior direction in the musical instrument case.

13. The keyboard instrument according to claim 10, wherein the first speaker is provided facing upward on an undersurface of a bottom portion of the musical instrument case, wherein the bottom portion of the of musical instrument case has a sound reception hole provided corresponding to the first speaker so as to take the sounds emitted from the first speaker into the musical instrument case, and wherein the second speaker is provided facing upward or provided at a tilt so as to be oriented toward an anterosuperior direction in the musical instrument case.

14. The keyboard instrument according to claim 1, wherein the speaker has a diffuser provided on an upper front side thereof which provides directivity toward a direction of the second opening section to the sounds emitted from the speaker.

15. The keyboard instrument according to claim 10, wherein the first speaker is a full-range speaker and the second speaker is a speaker for high-pitched sounds.

16. The keyboard instrument according to claim 11, further comprising a second opening section, the first and second opening sections being provided at respective positions such that, after the sounds emitted from the speaker and passing through the rear side hole have been separated toward the front side and the rear side of the keyboard lid, the respective separated sounds are emitted from the second and first opening sections, respectively.

* * * * *